US006047077A

United States Patent [19]

Larsen

[11] Patent Number: 6,047,077

[45] Date of Patent: Apr. 4, 2000

[54] BIPOLAR SPEAKER

[76] Inventor: John T. Larsen, 1443 Foxboro, Blue Springs, Mo. 64015

[21] Appl. No.: 09/162,273

[22] Filed: Sep. 29, 1998

[51] Int. Cl.[7] ..... H04R 25/00

[52] U.S. Cl. ..... 381/412

[58] Field of Search ..... 381/412, 414, 381/420, 421, 422, 182, 186, 430, 431, FOR 154, FOR 159, 89, 335, 423, 424; 181/144, 145

[56] References Cited

U.S. PATENT DOCUMENTS

| | | | |
|---|---|---|---|
| 4,472,605 | 9/1984 | Klein | 381/421 |
| 4,665,550 | 5/1987 | Haas | 381/430 |
| 5,524,061 | 6/1996 | Mooney et al. | 381/431 |
| 5,802,189 | 9/1998 | Blodget | 381/412 |

*Primary Examiner*—Huyen Le

*Attorney, Agent, or Firm*—Hovey, Williams, Timmons & Collins

[57] ABSTRACT

A loudspeaker (10) having at least one speaker assembly (12) that includes a diaphragm (18), a voice coil (20) for driving the diaphragm; and a magnet assembly (22) positioned adjacent the voice coil for producing a magnetic flux in the vicinity of the voice coil is disclosed. The magnet assembly includes a plurality of small magnets (32) arranged in a generally circular array. The magnets are each cylindrical in shape and are formed of a permanent magnet material such as neodymium. The loudspeaker preferably includes a pair of speaker assemblies (12,14) mounted in an opposed relationship to create a bipolar, omni-directional loudspeaker. A vent (16) is positioned between the speaker assemblies for introducing air into and passing air out of the speaker assemblies. The vent is designed for maximizing the amount of air flow into and out of the speaker assemblies to provide enhanced venting while eliminating any air noise during operation of the loudspeaker.

16 Claims, 3 Drawing Sheets

BIPOLAR SPEAKER

BACKGROUND OF THE INVENTION

1. Field of the Invention

The present invention relates to loudspeakers, and more particularly a bipolar loudspeaker that emits sound waves uniformly in all directions. The bipolar speaker of the present invention includes an improved magnet assembly and an improved venting configuration that enhance the operating characteristics of the speaker while minimizing the cost to construct the speaker.

2. Description of the Prior Art

Conventional loudspeakers include a funnel, dome, or calotte-shaped diaphragm that transmits sound in only one direction. To produce good stereophonic sound reproduction, these types of loudspeakers must be arranged in such a way that the sound waves emitted therefrom converge at a point or area in which listeners are located.

Another limitation with conventional loudspeakers is that they must be installed in cabinets or other enclosures and must have carefully calculated acoustic screening or dampening to avoid acoustic short circuiting from sound waves radiated from the rear side of the diaphragm. These requirements increase the size and cost of the loudspeakers and detract from their appearance.

U.S. Pat. No. 5,701,358 (the '358 patent), hereby incorporated by reference, discloses a bipolar loudspeaker that solves many of the above-described problems. However, the magnet assembly and venting structure of this loudspeaker suffer from limitations that limit their utility.

There is therefore a need for an improved loudspeaker that does not suffer from the limitations of conventional loudspeakers and that also improves upon the bipolar loudspeaker disclosed in the '358 patent.

OBJECTS AND SUMMARY OF THE INVENTION

The present invention solves the above-described problems and provides a distinct advance in the art by providing an electrodynamic loudspeaker that radiates sound uniformly in all directions, that does not require a special cabinet or other enclosure, and that has an improved magnet assembly and venting structure. The loudspeaker of the present invention broadly includes a diaphragm, a voice coil for driving the diaphragm; and a magnet assembly positioned adjacent the voice coil for producing a magnetic flux in the vicinity of the voice coil.

In accordance with the present invention, the magnet assembly includes a plurality of small magnets arranged in a generally circular array. The magnets are preferably each cylindrical in shape and are formed of a permanent magnet material such as neodymium. Applicant has discovered that the magnets of the present invention, and their arrangement, enhance the operating characteristics of the speaker while reducing the cost of the speaker.

In preferred forms, the loudspeaker includes a pair of speaker assemblies mounted in an opposed relationship to create a bipolar, omni-directional loudspeaker. Each of the speaker assemblies includes a diaphragm, a voice coil, and a magnet assembly constructed as described above. In accordance with another aspect of the present invention, the bipolar loudspeaker also includes a vent positioned between the opposed speaker assemblies for introducing air into and passing air out of the speaker assemblies. The vent is designed for maximizing the amount of air flow into and out of the speaker assemblies to provide enhanced venting while eliminating any air noise during operation of the loudspeaker.

BRIEF DESCRIPTION OF THE DRAWING FIGURES

A preferred embodiment of the present invention is described in detail below with reference to the attached drawing figures, wherein.

DETAILED DESCRIPTION OF THE PREFERRED EMBODIMENTS

Figure 1:
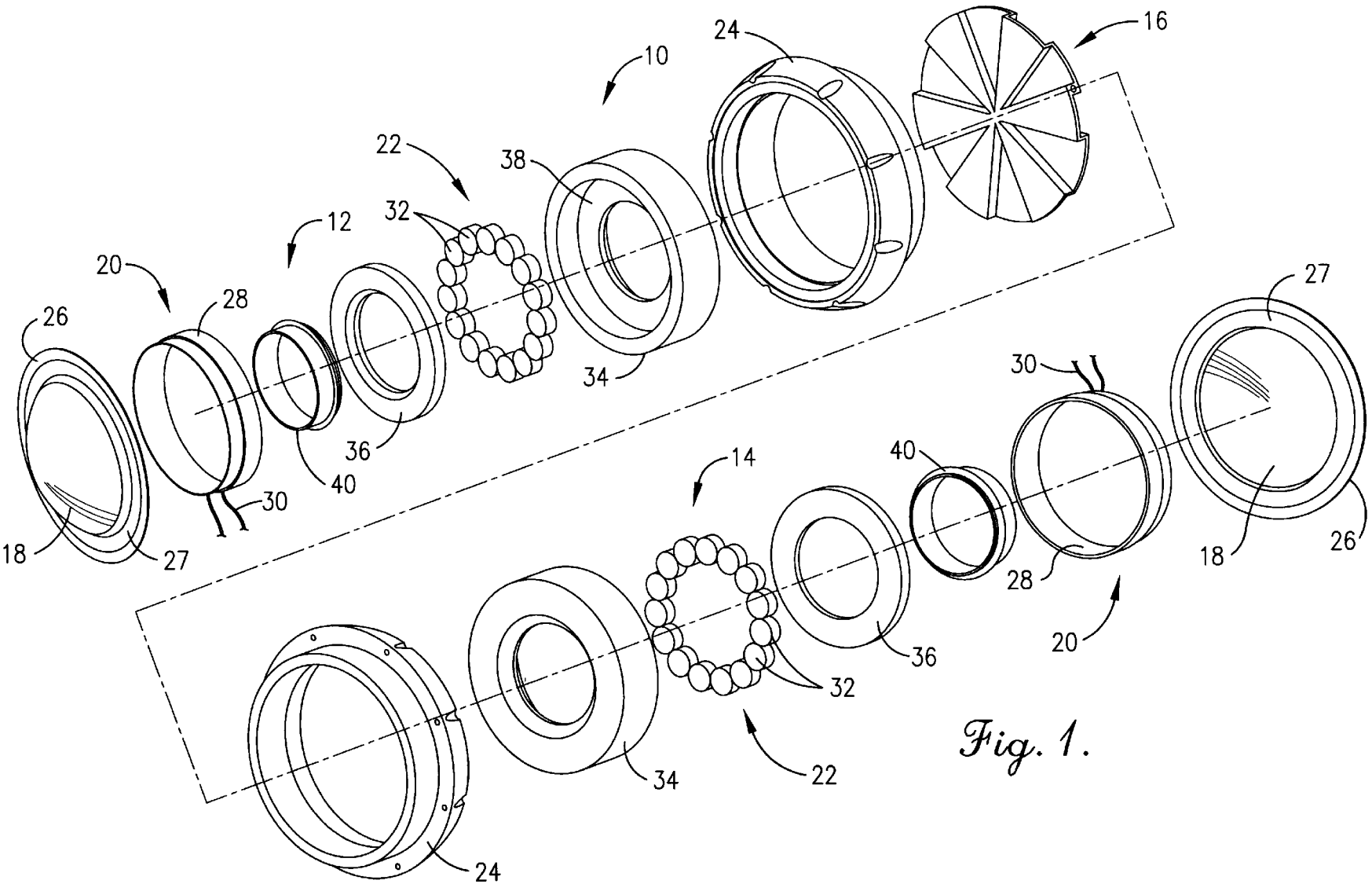
FIG. 1 is an exploded view of a bipolar loudspeaker constructed in accordance with a preferred embodiment of the present invention.

Turning now to the drawing figures, and particularly FIG. 1, a bipolar loudspeaker 10 constructed in accordance with a preferred embodiment of the present invention is illustrated. The loudspeaker broadly includes a pair of speaker assemblies 12,14 mounted in an opposed relationship and a vent 16 positioned between the speaker assemblies.

In more detail, the speaker assemblies 12,14 are substantially identical and each broadly includes a diaphragm 18, a voice coil 20, a magnet assembly 22, and a suspension tower 24. The diaphragm is preferably dome-shaped and may be formed of any suitable material such as polypropylene. As illustrated, the apex of the diaphragm extends outwardly from the voice coil so that the voice coil can be attached to the rim of the diaphragm rather than the apex of the diaphragm. Accordingly, a larger and more powerful voice coil can be utilized to drive the diaphragm.

Figure 5:
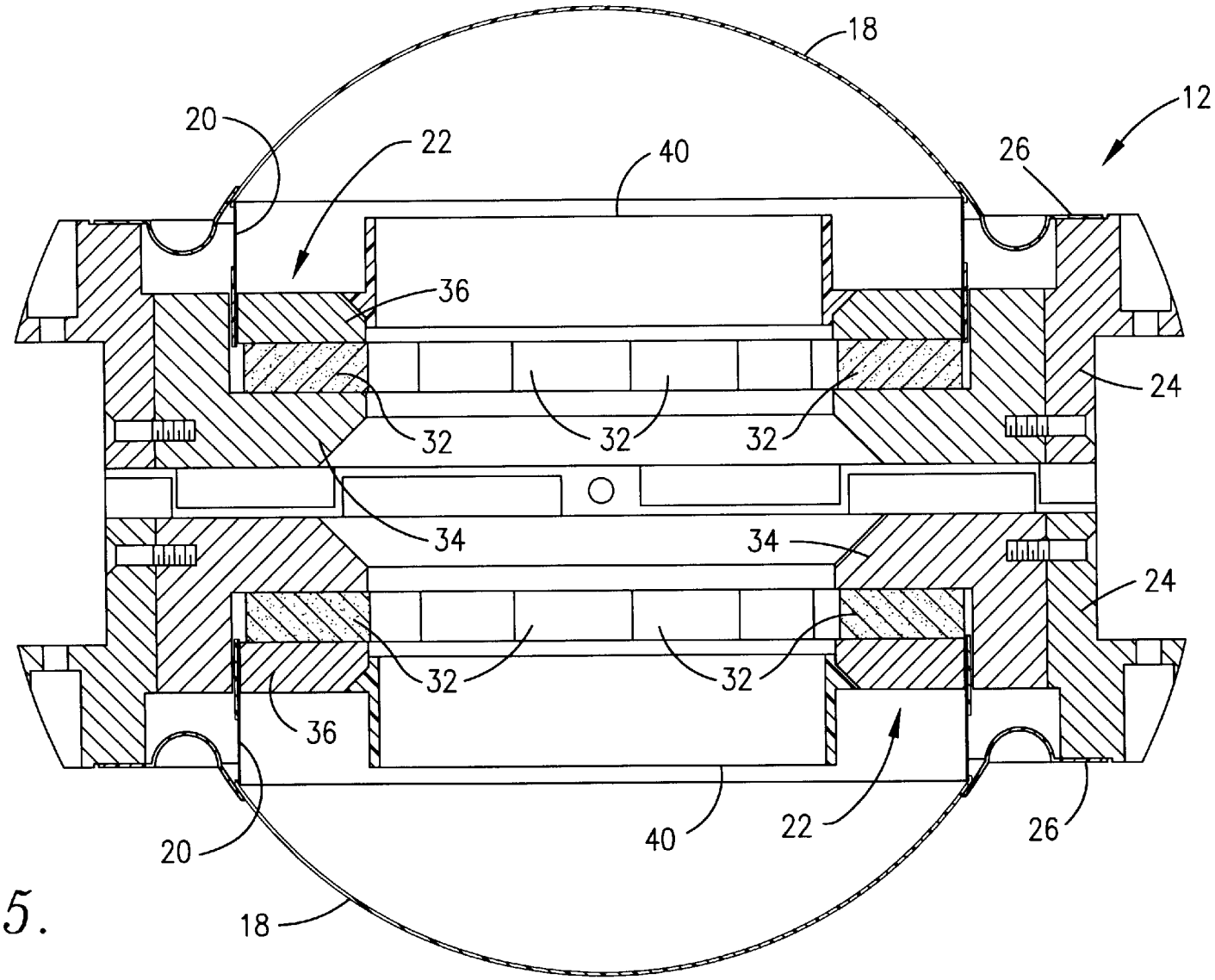
FIG. 5 is a partial vertical sectional view of the bipolar loudspeaker.

The rim of the diaphragm is preferably attached to an edge suspension device 26 that suspends the diaphragm above the magnet assembly. The suspension device is preferably ring-shaped and includes a plurality of accordion-shaped channels 27 extending between its inner and outer circumferential edges. The outer edge of the edge suspension is attached to the suspension tower as illustrated in FIG. 5. The suspension device allows the diaphragm to more freely vibrate for producing sound waves in response to variations in electrical signals supplied to the voice coil.

The voice coil 20 includes a ring-shaped former 28 and a length of electrically conductive wire 30 wound on the perimeter of the former. The ends of the wire are provided for attachment to input terminals that may be connected to a source of alternating current. When the wires receive an alternating current, the voice coil vibrates the diaphragm in a conventional manner.

In accordance with one aspect of the present invention, the magnet assembly 22 includes a plurality of small magnets 32, a carrier plate 34 for receiving the magnets, and a top plate 36 for encasing the magnets in the carrier plate. The magnets are preferably arranged in the carrier plate in a circular array. Each of the magnets is cylindrical in shape and formed of neodimium or other permanent magnetic material. The magnets are preferably approximately 25 mm in diameter and 10 mm in height.

The carrier plate 34 is generally ring-shaped and includes a circular recess 38 for receiving and supporting the array of magnets 32. The top plate 36 is also ring-shaped and fits in the recess of the carrier plate to hold the magnets in the carrier plate. The carrier plate and top plate are preferably formed of carbon steel and serve as magnetic flux rings that are magnetized by the circular array of magnets. This produces a magnetic flux in the vicinity of the voice coil. The magnet assembly may also include a cap 40 for securely holding the top plate in the carrier plate.

The suspension tower 24 is generally ring-shaped and is configured for receiving and supporting the magnet assembly 22, voice coil 20, and diaphragm 18 as illustrated in FIG. 5. The suspension towers of the two speaker assemblies may be mounted in a stand or rack for elevating the speaker 10 from the ground or suspending the speaker from a ceiling or wall.

In accordance with another aspect of the present invention, the vent 16 is positioned between the two opposed speaker assemblies for introducing air into and passing air out of the speaker assemblies. The vent is designed for maximizing the amount of air flow into and out of the speaker assemblies to provide enhanced venting while eliminating any air noise during operation of the speakers.

Figure 2:
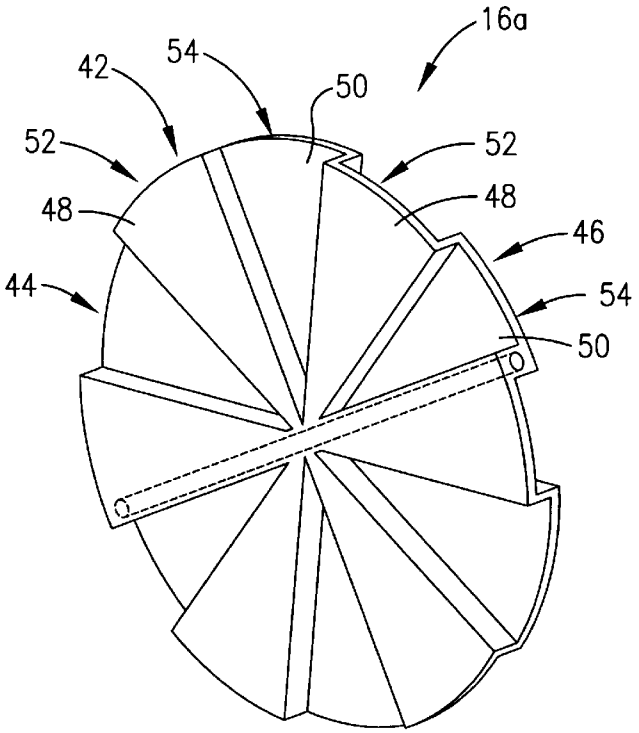
FIG. 2 is a perspective view of one embodiment of a vent for the bipolar loudspeaker.

As best illustrated in FIG. 2, one embodiment of the vent 16*a* includes a disk-shaped base 42 having opposed faces 44,46. Each of the faces includes a plurality of alternating, wedge-shaped peaks 48 and valleys 50 that define therebetween a plurality of circumferentially spaced openings 52,54. The openings 52 introduce air into one of the speaker assemblies, and the openings 54 introduce air into the opposite speaker assembly. The vent also includes a passageway 56 extending across the diameter thereof for passing wires through the sides of the vent.

Figure 4:
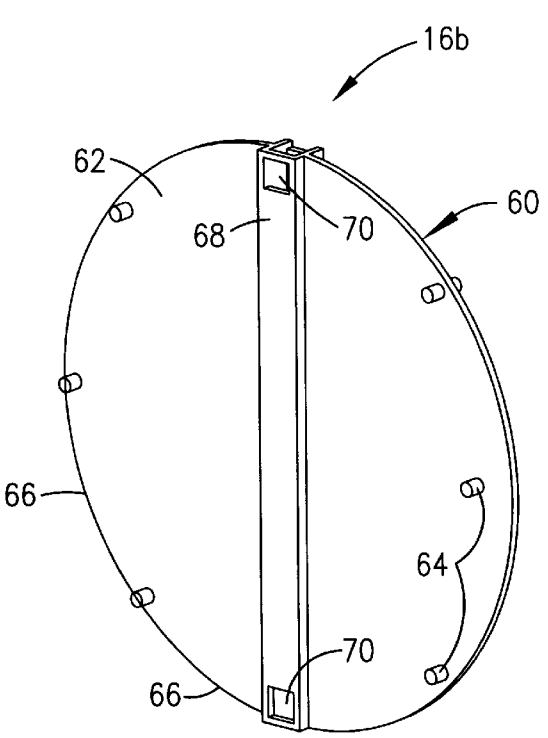
FIG. 4 is a perspective view of the vent of FIG. 3 showing the opposite side of the vent.
Figure 3:
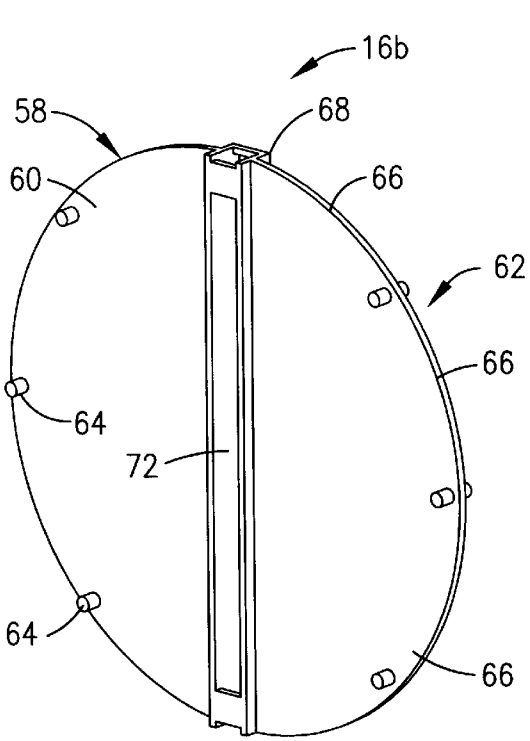
FIG. 3 is a perspective view of another embodiment of a vent for the bipolar loudspeaker showing one side of the vent.

A second embodiment of the vent 16*b* illustrated in FIGS. 3 and 4 includes a disk-shaped base 58 having a pair of opposed faces 60,62 and a plurality of circumferentially-spaced pegs 64 extending from the faces. The pegs define therebetween a plurality of openings 66 for introducing air into and passing air out of the speaker assemblies. The vent 16*b* also includes an elongated hollow beam-shaped channel 68 extending across the diameter of the two faces. The channel includes a pair of openings 70 on one side thereof and a larger, elongated opening 72 on the other side for passing wires across the sides of the speaker.

Although the invention has been described with reference to the preferred embodiment illustrated in the attached drawing figures, it is noted that equivalents may be employed and substitutions made herein without departing from the scope of the invention as recited in the claims. Some of the components of the loudspeaker are illustrated and described in more detail in U.S. Pat. No. 5,701,358, which is hereby incorporated into the present application by reference.

Having thus described the preferred embodiment of the invention, what is claimed as new and desired to be protected by Letters Patent includes the following:

1. A loudspeaker comprising:

a diaphragm;

a voice coil for driving the diaphragm; and a magnet assembly positioned adjacent the voice coil for producing a magnetic flux in the vicinity of the voice coil, the magnet assembly including a plurality of magnets arranged in a generally circular array, adjacent ones of the magnets touching one another so that the magnets collectively form a single magnetic pole piece with no spaces therebetween.

2. The loudspeaker as set forth in claim 1, the magnets each being generally cylindrical in shape.

3. The loudspeaker as set forth in claim 2, the magnets each being approximately 25 mm in diameter and 10 mm in height.

4. The loudspeaker as set forth in claim 1, the magnets each being formed of permanent magnetic material.

5. The loudspeaker as set forth in claim 4, the magnets each being formed of neodymium.

6. A loudspeaker comprising:

a pair of speaker assemblies mounted in an opposed relationship, each of the speaker assemblies including a diaphragm, a voice coil for driving the diaphragm, and a magnet assembly positioned adjacent the voice coil for producing a magnetic flux in the vicinity of the voice coil; and a vent positioned between the speaker diaphragms, the vent including solid, imperforate structure for introducing air into and passing air out of each of the speaker assemblies respectively, said structure preventing passage of air therethrough and between the diaphragms.

7. The loudspeaker as set forth in claim 6, the vent including a disk-shaped base having opposed faces, each of the faces including a plurality of alternating, wedge-shaped peaks and valleys defining a plurality of circumferentially spaced openings for introducing air into and passing air out of the speaker assemblies and for preventing air from passing between the speaker assemblies.

8. The loudspeaker as set forth in claim 6, the vent including a disk-shaped base having opposed faces and a plurality of circumferentially-spaced pegs extending from the faces, the pegs defining therebetween a plurality of openings for introducing air into and passing air out of the speaker assemblies and for preventing air from passing between the speaker assemblies.

9. The loudspeaker as set forth in claim 6, the magnet assembly including a plurality of magnets arranged in a generally circular array wherein adjacent ones of the magnets touch one another so that the magnets collectively form a single magnetic pole piece with no spaces therebetween.

10. The loudspeaker as set forth in claim 9, the magnets each being generally cylindrical in shape.

11. The loudspeaker as set forth in claim 9, the magnets each being approximately 25 mm in diameter and 10 mm in height.

12. The loudspeaker as set forth in claim 9, the magnets each being formed of permanent magnetic material.

13. The loudspeaker as set forth in claim 12, the magnets each being formed of neodymium.

14. The loudspeaker as set forth in claim 1, the magnet assembly further including a ring-shaped carrier plate having a circular recess for receiving and supporting the magnets therein, the carrier plate and magnets collectively forming the single magnetic pole piece.

15. The loudspeaker as set forth in claim 14, the magnet assembly further including a top plate for encasing the magnets in the recess of the carrier plate.

16. The loudspeaker as set forth in claim 1, the magnets collectively presenting a central opening.

* * * * *